US005628507A

United States Patent [19]

Johnson

[11] Patent Number: 5,628,507

[45] Date of Patent: May 13, 1997

[54] GOAL PROTECTOR

[76] Inventor: Ealuard J. Johnson, 45 County Rd. 116, Tishominge, Miss. 38873

[21] Appl. No.: 633,161

[22] Filed: Apr. 16, 1996

[51] Int. Cl.[6] ..... A63B 71/02

[52] U.S. Cl. ..... 473/479; 206/315.1

[58] Field of Search ..... 273/1.5 R, 1.5 A; 206/315.1

[56] References Cited

U.S. PATENT DOCUMENTS

| | | | |
|---|---|---|---|
| 4,213,606 | 7/1980 | Wilson | 273/1.5 A |
| 4,226,416 | 10/1980 | Callana | 273/1.5 A |
| 5,000,238 | 3/1991 | Zeller | 206/315.4 X |
| 5,405,132 | 4/1995 | Orge | 273/1.5 A |
| 5,433,095 | 7/1995 | Mitchell et al. | 273/1.5 A |
| 5,439,210 | 8/1995 | Davis | 273/1.5 A |

*Primary Examiner*—Paul E. Shapiro

*Attorney, Agent, or Firm*—Patent & Trademark Serv.; Joseph H. McGlynn

[57] ABSTRACT

A basket ball goal protector having two portions, one which is placed on top of the goal and the second is placed on the bottom. The two portions are hinged together so the basketball rim and goal can be enclosed between the two portions. Hooks are provided on the underside of the first portion so the net can be secured and will not get in the way as the two portions are secured to the goal. A lock is also provided so the protector can be secured and, can be removed only by authorized personnel. In addition, a seal is provided which will completely seal the goal from the elements.

9 Claims, 1 Drawing Sheet

GOAL PROTECTOR

BACKGROUND OF THE INVENTION

This invention relates, in general, to an accessory for a basketball goal, and, in particular, to a cover which will protect the goal from the elements and, also will prevent unauthorized use of the goal.

DESCRIPTION OF THE PRIOR ART

In the prior art various types of basketball goal accessories have been proposed. For example, U.S. Pat. No. 4,213,606 discloses a basketball training device having a support hoop and a secondary hoop of a larger diameter than a standard hoop which allows players to shoot from the side and see a larger target to aim at.

U.S. Pat. No. 4,226,416 discloses a basketball practice assembly consisting of two semicircular hoops that attach to the standard hoop to assist players in their shooting.

U.S. Pat. No. 5,405,132 discloses a basketball net assembly which can be temporarily placed within a standard hoop and quickly removed.

U.S. Pat. No. 5,433,095 discloses a basketball hoop lock consisting of a support that can be placed on top of a standard hoop and has at least one cross piece that prevents anyone from using the basketball goal.

U.S. Pat. No. 5,439,210 discloses a locking device for a basketball goal which consists of a bar which fits across the standard goal and which can be locked in place to prevent use of the goal.

Although there have been many types of basketball goal accessories suggested, none of the accessories from the prior art have addressed the problem of protecting a basketball goal from the elements. As a goal is subjected to the elements the rims tend to rust and the nets will become brittle over time. Eventually they will have to be replaced resulting in an additional expense. Public playgrounds are especially faced with this problem since they usually have many courts. Replacing rims and nets that have been degraded by the elements can be costly and time consuming. Also, some areas have a further problem with the theft of equipment form public areas. What is needed is a basketball accessory that will protect the equipment from the elements, as well as theft and vandalism.

SUMMARY OF THE INVENTION

The present invention is designed to overcome the problems and inadequacies associated with the prior art devices. It consists of two portions, one which is placed on top of the goal and the second is placed on the bottom. The two portions are hinged together so the basketball rim and goal can be enclosed between the two portions. Hooks are provided on the underside of the first portion so the net can be secured and will not get in the way as the two portions are secured to the goal. A lock is also provided so the protector can be secured and can be removed only by authorized personnel. In addition, a seal is provided which will completely seal the goal from the elements.

It is an object of the present invention to provide a new and improved protector for a basketball goal that will protect the goal from the elements.

It is an object of the present invention to provide a new and improved protector for a basketball goal that will prevent unauthorized personnel from using the goal.

These and other objects and advantages of the present invention will be fully apparent from the following description, when taken in connection with the annexed drawings.

DESCRIPTION OF THE PREFERRED EMBODIMENT

Figures 1, 2, 3, 4, 5, 6, 7:
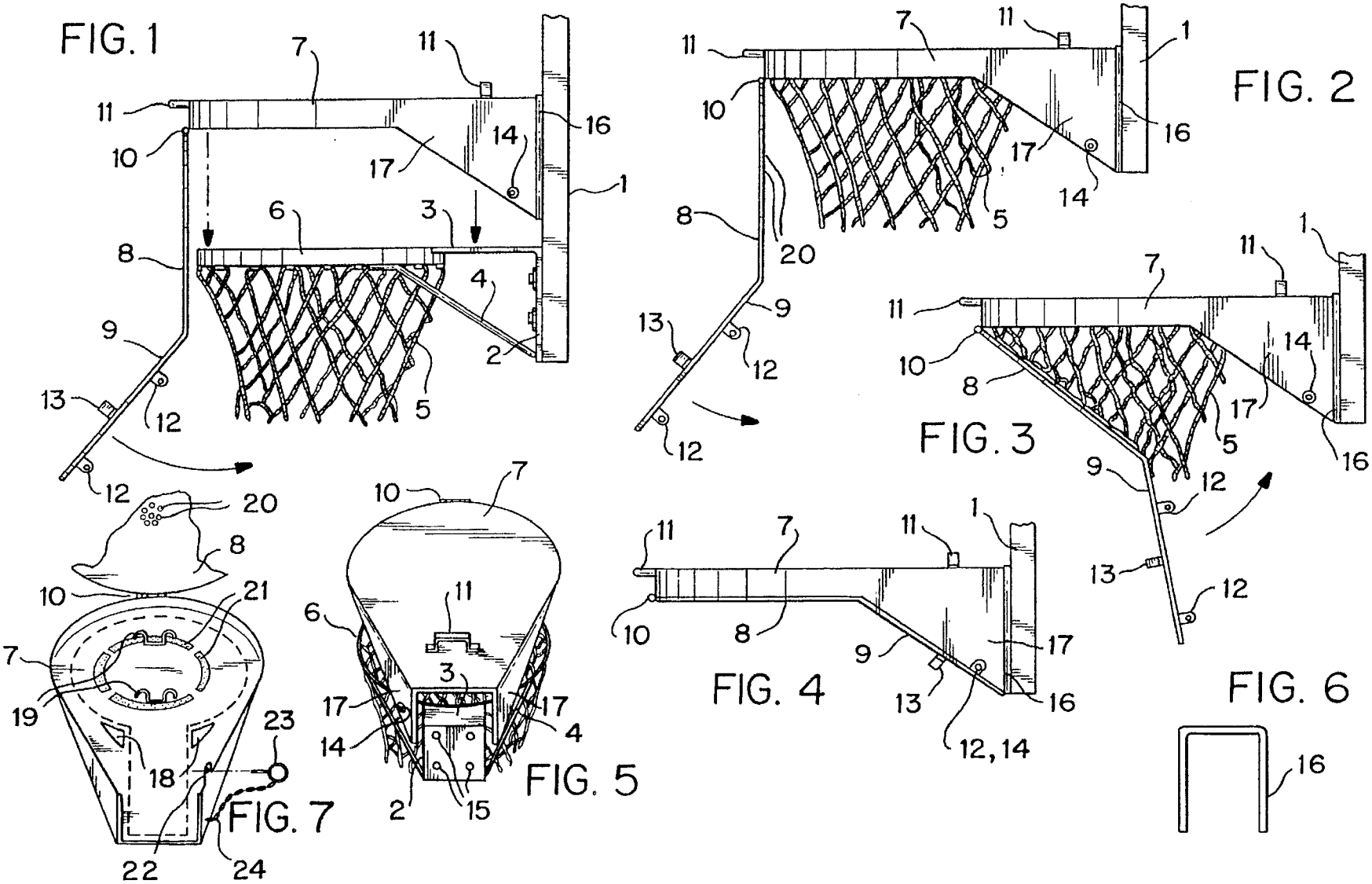
FIG. 1 is a side view of the present invention before it is placed on the goal.
FIG. 2 is a side view of the present invention with the top portion in place.
FIG. 3 is a side view of the present invention with the bottom portion about to be rotated into place.
FIG. 4 is a side view of the present invention with the protector in place.
FIG. 5 is a back view of the present invention.
FIG. 6 is a view of the seal used with the present invention.
FIG. 7 is a view of the underside of the top portion of the present invention.

Referring now to the drawings in greater detail, FIG. 1 shows the protector of the present invention about to be assembled to a basketball goal. The goal consists of a standard hoop 6, a support bracket 2 for attaching the goal to a backboard 1, a brace 2, and a net 5.

The protector has a top portion 7 and a side flange 17 depending from each side of the top portion. Secured to at least one of the flanges 17 is a lock 14 which will lock the protector to the goal so unauthorized personnel will not be able to remove the protector after it is locked in place. Any conventional lock can be used with the present invention and while a key operated lock is shown in the drawings, it should be understood that this is merely for illustrational purposes. Other types of locks could be used, for example, a headed bar with a hole in one end could be placed through a hole on the flanges 17 and a padlock could be placed through the hole in the bar to prevent its removal.

FIG. 2 shows the protector of the present invention with the top portion in place on the basketball goal. The bottom portion 8 is hinged to the top portion by a conventional hinge 10. The hinge will allow the bottom portion 8, 9 to be pivoted as shown by the arrow in FIG. 3 to enclose the entire basketball goal. Top portion 7 has a pair of handles 11 which will make it easier to maneuver the protector as it is being placed on and removed from the basketball goal. Also, the bottom portion 9 has a similar handle 13 which will make it easier to pivot the bottom portion into place. Handles 12, on the inner side of the bottom portion are also for maneuvering the protector, and can be used in conjunction with the lock 14 to secure the protector to the goal. For example, the key lock 14 could have a bar inside flange 17 which is rotated when the key is turned in the lock. The bar would rotate into position between the handle 12 and the underside of the bottom portion 9 to secure the protector to the basketball goal.

FIG. 4 shows the protector in place on the basketball goal and the bottom portion 8, 9 has been pivoted into position and locked to secure the protector to the goal. It should be noted that the portion 8 is placed at an angle to the portion 9 in order to accommodate the most common type of basketball goal. If other types of goals are used these portions could be oriented differently in order to accommodate a different type of basketball goal.

FIG. 5 show the protector from the back as it is about to be placed onto the goal. Apertures 15 are used to secure the goal to the backboard 1. In addition this figure shows the backside of the flange 17 that will be placed against the backboard 1 when the protector is in place. FIG. 6 shows a rubber seal 16 that is shaped to match the contour of the flange 17 so it can be placed between the flange and the backboard 1 in order to seal the elements completely from the interior of the protector. The seal could be made form any type or resilient sealing material such as, but not limited to, rubber or plastic.

FIG. 7 shows the underside of the upper portion 7 of the protector. It is provided with a reinforcing ring 21 which is secured to 7 by any conventional means such as, but not limited to, welding. Ring 21 will help support the upper portion and prevent it from being knocked out of shape. Also, on the underside of the upper portion 7 of the protector is a pair of hooks 19. These hooks could be used to hold the net 5 (by wrapping the net around the hooks) so it will not get in the way and become pinched between the upper and lower portions of the protector as it is being pivoted into position around the goal. The ends of the hooks can have rubber caps to help protect the net 5.

Also shown in FIG. 7 is a pair of guide flanges 18 which will help guide the protector onto the basketball goal. The dotted lines show the approximate position of the basketball goal, and the guide flanges 18 will engage the goal if the protector is not aligned properly and help to guide the protector onto the goal.

In addition, FIG. 7 shows a safety pull pin 23 attached to the flange 17 by a chain 24. The safety pull pin 23 can pass through an apertured flange 22 on the flange 17 and then through an aperture in the end of one of the handles 12 to secure the protector on the goal when the protector is not locked. This will allow a user to unlock the protector and grab handle 13 before the bottom portion 8, 9 is released. This will make it easier to remove the protector without just letting the bottom portion fall away from the top portion 7. Also, a headed bar, as noted above, can be inserted into the aperture in flange 22 and locked for added security.

The upper and lower portions of the protector can be made from any type of material that is either waterproof or at least water resistant. Examples of the materials that can be used include plastic, metal, and exterior plywood. Where necessary these materials could be protected by paint or varnish to prolong their life.

Although the basketball goal protector and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A protector for a basketball goal attached to a backboard comprising:

a first portion adapted to be positioned on top of a basketball goal, a second portion having means for movingly connecting said second portion to said first portion, said first portion has a substantially closed top, an open bottom and sides, and said second portion engages said open bottom to form an enclosure for said basketball goal said second portion being movable from a first position in which said basketball goal is not covered to a second position in which said basketball goal is encased by said first and second portions, lock means for securing said first and second portions to said basketball goal.

2. The protector for a basketball goal as claimed in claim 1, wherein said first and second portions have handle means for maneuvering said first and second portions into position.

3. The protector for a basketball goal as claimed in claim 1, wherein said means for movably connecting said second portion to said first portion comprises a hinge.

4. The protector for a basketball goal as claimed in claim 1, wherein a seal means is secured between said protector and said backboard when said protector is attached to said basketball goal to seal the goal from the elements.

5. The protector for a basketball goal as claimed in claim 1, wherein the top of said first portion has an underside, said underside of said top having a reinforcing means attached thereto to strengthen said first portion.

6. The protector for a basketball goal as claimed in claim 1, wherein the top of said first portion has an underside, said underside of said top having at least one hook means for securing a net attached to said basketball goal.

7. The protector for a basketball goal as claimed in claim 1, wherein said second portion has ventilation means thereon for allowing air to enter said protector to remove any moisture that might become trapped inside the protector.

8. The protector for a basketball goal as claimed in claim 1, wherein said first portion has at least one guide means for assisting in placing said protector onto said basketball goal.

9. The protector for a basketball goal as claimed in claim 1, wherein a pin means is attached to said first portion and said second portion for securing said portions together when said lock means is not locked.

* * * * *